US006613501B2

(12) United States Patent
Fukazawa et al.

(10) Patent No.: US 6,613,501 B2
(45) Date of Patent: Sep. 2, 2003

(54) SILVER HALIDE PHOTOGRAPHIC MATERIAL

(75) Inventors: Fumie Fukazawa, Hino (JP); Tsukasa Ito, Hino (JP)

(73) Assignee: Konica Corporation (JP)

( * ) Notice: Subject to any disclaimer, the term of this patent is extended or adjusted under 35 U.S.C. 154(b) by 36 days.

(21) Appl. No.: 09/950,303

(22) Filed: Sep. 10, 2001

(65) Prior Publication Data

US 2002/0061477 A1 May 23, 2002

(30) Foreign Application Priority Data

Sep. 18, 2000 (JP) ..... 2000-281308

(51) Int. Cl.[7] ..... G03C 1/46

(52) U.S. Cl. ..... 430/505; 430/496; 430/502; 430/503; 430/504; 430/506; 430/507

(58) Field of Search ..... 430/496, 502, 430/503, 504, 505, 506, 507

(56) References Cited

U.S. PATENT DOCUMENTS

| | | | | |
|---|---|---|---|---|
| 4,554,245 A | | 11/1985 | Hayashi et al. | |
| 4,599,302 A | | 7/1986 | Scheerer | |
| 4,952,485 A | * | 8/1990 | Shibahara et al. | 430/502 |
| 5,091,293 A | * | 2/1992 | Nozawa et al. | 430/503 |
| 5,389,506 A | | 2/1995 | Sutton | |
| H001593 H | * | 9/1996 | Haraga et al. | 430/496 |
| 5,840,470 A | | 11/1998 | Bohan et al. | |

FOREIGN PATENT DOCUMENTS

| | | |
|---|---|---|
| DE | 19749589 | 10/1998 |
| EP | 845704 | 6/1998 |

OTHER PUBLICATIONS

European Search Report EP 01 30 7883.

* cited by examiner

*Primary Examiner*—Geraldine Letscher
(74) *Attorney, Agent, or Firm*—Muserlian, Lucas and Mercanti, LLP

(57) ABSTRACT

A silver halide photographic material is disclosed comprising a blue-sensitive silver halide unit containing a yellow coupler, a green-sensitive silver halide unit containing magenta coupler, and a red-sensitive silver halide unit containing a cyan coupler, wherein a coefficient of utilization of an oxidation product of a color developing agent in a maximum density area of the blue-sensitive unit is not less than 80%, that of the green-sensitive unit is 30 to 75% and that of the red-sensitive unit is not less than 80%.

10 Claims, No Drawings

SILVER HALIDE PHOTOGRAPHIC MATERIAL

FIELD OF THE INVENTION

The present invention relates to silver halide color photographic materials exhibiting enhanced sensitivity sufficient for recording images and superior graininess, and a color image forming process by use thereof.

BACKGROUND OF THE INVENTION

Silver halide photographic light-sensitive materials and a system making use thereof recently progressed, enabling any one to simply obtain high quality color images.

On the other hand are also under way rapid advances of so-called digital still cameras employing CCD as an imaging element. In order to obtain image quality close to silver salt photographic images, cameras installed with a CCD element having a few million pixels have been introduced into the consumer market for amateur use. Digital still cameras can directly obtain digitized image data, without necessitating any step for developing an exposed photographic film, such as in a conventional color photographic system, whereby images can be instantaneously confirmed on a liquid crystal monitor at the time of picture-taking or obtained digital information can be utilized in various manners. Although improvements in performance of CCD employed as an imaging element for digital cameras has progressed markedly, it is limited in providing enhanced sensitivity, while increasing the number of pixels within a limited size. Further, it is in principle difficult to provide broad latitude within a limitation of a low-priced and simple camera system. Accordingly, if silver halide photographic materials achieve further enhanced sensitivity and broad latitude and can be loaded into low-priced and easily handling goods, such as a lens-fitted film package, a fascinating system for users can be provided.

The speed of silver halide photographic materials are enhanced over time and among commercially available color negative film, film having an ISO speed of 400 is mainly employed. As is well known, enlarging silver halide grains is effective to enhance the speed of a silver halide photographic material. However, the use of silver halide grains having a relatively large size often deteriorates graininess, vitiating image quality. Increasing the number of silver halide grains per unit area of photographic material is effective to improve such a disadvantage. In commercially available color negative films, the silver coverage proportionally increases with an increase in speed. However, in cases when high sensitive silver halide grains are integrated, in a relative high silver coverage, into a photographic material, influences due to natural radiation cannot be neglected, resulting in deterioration in performance, such as increased fogging or deteriorated graininess caused during product storage. To overcome such problems, U.S. Pat. No. 5,091,293 discloses a technique for reducing silver coverage of a photographic material, while exhibiting a relatively high speed. However, the technique disclosed therein was insufficient for compensating for lowered sensitivity or deteriorated graininess accompanied with the reduction in silver coverage.

Regarding requirements for resource-saving and cost reduction, however, there is still desired a silver halide photographic material having a relatively low silver coverage, without vitiating sensitivity or graininess, while exhibiting superior radiation resistance.

SUMMARY OF THE INVENTION

Accordingly, it is an object of the invention to provide a silver halide photographic material for camera use, exhibiting enhanced sensitivity, improved graininess and superior radiation resistance, irrespective of its relatively low silver coverage.

The object of the invention can be accomplished by the following constitution:

1. A silver halide photographic light-sensitive material comprising on a support a blue-sensitive silver halide light-sensitive unit comprising at least a blue-sensitive silver halide emulsion layer containing a yellow dye forming coupler, a green-sensitive silver halide light-sensitive unit comprising at least a green-sensitive silver halide emulsion layer containing a magenta dye forming coupler, and a red-sensitive silver halide-light sensitive unit comprising at least a red-sensitive silver halide emulsion layer containing a cyan dye forming coupler, wherein a coefficient of utilization of an oxidation product of a color developing agent in a maximum density area of the blue-sensitive unit (denoted as CUB) is not less than 80%, a coefficient of utilization of an oxidation product of a color developing agent in a maximum density area of the green-sensitive unit (denoted CUG) is 30 to 75% and a coefficient of utilization of an oxidation product of a color developing agent in a maximum density area of the red-sensitive unit (denoted as CUR) is not less than 80%.

Furthermore, preferred embodiments of the invention are as follows:

2. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein a coefficient of utilization of an oxidation product of a color developing agent in a maximum density area of each of the light-sensitive units meets the following requirements:

(1) blue-sensitive unit≧80%

(2) green-sensitive unit of 30 to 75%

(3) red-sensitive unit≧80%;

3. the silver halide photographic material as described in 2, wherein the coefficient of utilization of an oxidation product of a color developing agent in a maximum density area of each of the light-sensitive units is the following order:

blue-sensitive unit>red-sensitive unit>green-sensitive unit;

4. the silver halide photographic material as described in 2, wherein the coefficient of utilization of an oxidation product of a color developing agent in a maximum density area of each of the light-sensitive units is the following order:

red-sensitive unit>blue-sensitive unit>green-sensitive unit;

5. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein a coefficient of development of silver halide in a maximum density area of the blue-sensitive silver halide light-sensitive unit is 70 to 90% when subjected to blue light exposure and said coefficient being 50 to 70% when subjected to neutral white neutral light exposure;

6. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein a coefficient of development of silver halide in a maximum density area of the red-sensitive silver halide light-sensitive unit is 70 to 90% when subjected to red light exposure, and said coefficient being 40 to 60% when subjected to neutral white light exposure 7. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein the photographic material has an ISO speed of not less than 320, and a coefficient of utilization of an oxidation product of a color developing agent in a maximum density area of at least one of the light-sensitive units being not less than 80%;

8. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein the photographic material has a dry layer thickness of not more than 20 $\mu$m, and a coefficient of utilization of an oxidation product of a color developing agent in a maximum density area of at least one of the light-sensitive units being not less than 80%;

9. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein the photographic material has a silver coverage of not more than 50 mg/m$^2$, and a coefficient of utilization of an oxidation product of a color developing agent in a maximum density area of at least one of the light-sensitive units being not less than 80%;

10. a silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein the photographic material has an ISO speed of not less than 320, and a coupler dye-forming coefficient in a maximum density area of at least one of the light-sensitive units being not less than 80%;

11. silver halide photographic light-sensitive material comprising a support having thereon a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, wherein the photographic material has a dry layer thickness of 20 $\mu$m, and a coupler dye-forming coefficient in a maximum density area of at least one of the light-sensitive units being not less than 80%;

12. the silver halide photographic material as described in any of 2 through 11, wherein at least one of silver halide emulsions contained in the photographic material comprises tabular grains;

13. the silver halide photographic material as described in any of 2 through 12, wherein at least one of the silver halide light-sensitive layers of the photographic material is a donor layer; and 14. an image forming layer by use of a silver halide photographic material as claimed in any of claims 1 through 12, wherein an image formed by subjecting the photographic material to exposure and processing is read by an image sensor such as a scanner or CCD camera, obtained image data are digitized and digital data is recorded on another recording medium.

DETAILED DESCRIPTION OF THE INVENTION

Examples of yellow couplers, magenta couplers and cyan couplers usable in the invention include commonly known photographic couplers in the art, such as those described in Research Disclosure 308119, page 1001, Sect. VII-D.

The photographic material according to the invention comprises a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler. The light-sensitive unit refers to a unit integrated for each color of the light-sensitive silver halide emulsion layers. Commercially available color negative film, for example, comprises three light-sensitive units corresponding to red, green and blue and each of the units usually comprises two or three silver halide emulsion layers.

The coefficient of development (%) of silver halide in the maximum density area of each light-sensitive unit can be determined according to the following procedure.

(1) A photographic material, which comprises a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide-light sensitive unit comprising at least a red-sensitive silver halide emulsion layer containing a cyan coupler, is divided into two parts, which are respectively denoted as Sample (a) and Sample (b).

(2) Using a light source having a wavelength region to which the light-sensitive unit concerned are sensitive, Sample (a) is exposed to light for 1/100 sec. and then subjected to color development described later (in Examples). After development, Sample (a) is processed in a stop solution at 33° C. for 30 sec., which was prepared by adjusting 0.1 M acetic solution to a pH with sodium hydroxide or sulfuric acid, and then subjected to fixing described later (in Examples), washing and drying.

(3) Using the same light source as used in (2), Sample (b) was exposed for 10 min. or more, then, developed with the same developer as used in (2) for 10 min. and further subjected to stop, fixing, washing and drying, similarly to Sample (a).

(4) The thus processed Samples (a) and (b) were divided into two parts, which were denoted as Samples (a1), (a2), (b1) and (b2), respectively. Samples (a1) and (b1) were determined with respect to the developed silver amount on their supports, according to a commonly known method. The thus obtained silver amount was divided by the silver coating amount (or silver coverage) of the light-sensitive unit concerned. The silver amount of Sample (a1) was represented by a relative value (%), based on the silver amount of Sample (b1) being 100. Thus, this value is a coefficient of development (%) of silver halide in the maximum density area of the light-sensitive unit concerned. In cases where the photographic material contains colloidal silver used for antihalation or in a filter, the amount of the colloidal silver is subtracted from the silver amount determined in (4).

In cases when the photographic material is exposed to white neutral light, the coefficient of development (%) of silver halide in the maximum density area for each light-sensitive unit can also be determined similarly. Thus, the foregoing procedures (1) through (3) are conducted, provided that neutral white light (or daylight) is used as a light source. The thus processed sample is photomicrographically observed using an optical microscope. From the obtained tomographic picture of the light-sensitive unit concerned, the density of the light-sensitive unit is determined and comparing it with the density of the light-sensitive unit, obtained when subjected to separation exposure (in which the developed silver amount is known), the silver amount is determined, based on a calibration curve between density and silver amount which was previously determined.

Herein, as a neutral white light source is used ISO sensitometric daylight, as described in ISO 7589. Relative spectral energy distribution of the white light source is as follows.

| Wavelength | Spectral Energy* | Wavelength | Spectral Energy |
|---|---|---|---|
| 360 (nm) | 2 | 370 (nm) | 8 |
| 380 | 14 | 390 | 23 |
| 400 | 45 | 410 | 57 |
| 420 | 63 | 430 | 62 |
| 440 | 81 | 450 | 93 |

-continued

| Wavelength | Spectral Energy* | Wavelength | Spectral Energy |
|---|---|---|---|
| 460 | 97 | 470 | 98 |
| 480 | 101 | 490 | 97 |
| 500 | 100 | 540 | 102 |
| 550 | 103 | 560 | 100 |
| 570 | 97 | 580 | 98 |
| 590 | 90 | 600 | 93 |
| 610 | 94 | 620 | 92 |
| 630 | 88 | 640 | 89 |
| 650 | 86 | 660 | 86 |
| 670 | 89 | 680 | 85 |
| 690 | 75 | 700 | 77 |

*1: Spectral energy is represented by a relative value, based on that of 560 nm being 100.

In cases when exposed to blue, green or red light, this neutral white light is used in combination with Wratten filter W-98 (blue filter), W-99 (green filter) or W-26 (red filter), respectively (all of which are available from Eastman Kodak co.). In the case of exposure to blue light, for example, the photographic material is exposed, through Wratten filter W-98, to the neutral white light source.

Next, determination of the coupler dye-forming coefficient (%) in the maximum density area for each light-sensitive unit concerned will be described below.

(11) Processed Samples (a2) and (b2) obtained in the foregoing (4) are further subjected to bleaching described later (in Examples), fixing, washing and drying.

(12) The thus processed Samples (a2) and (b2) are determined with respect to color density, and the density of Sample (b2) is designated as a density obtained when all of the coupler contained in the light-sensitive unit concerned have undergone dye formation. The density of Sample (a2) is represented by relative value (%), based on the density of Sample (a2) being 100. Thus, this value is the coupler dye-forming coefficient (%) in the maximum density area of the light-sensitive unit concerned. When exposed to white light, the coupler dye-forming coefficient (%) in the maximum density area of each light-sensitive unit can be similarly determined in accordance with the foregoing procedures (1) through (3), (11) and (12), provided that day-light is used as a light source.

The coefficient of utilization (%) of an oxidation product of a color developing agent in the maximum density area for each of the light-sensitive units can be determined from the foregoing coefficient of development of silver halide (%) and coupler dye-forming coefficient (%) in the maximum density area for each light-sensitive unit (or from measured or calculated values in determination thereof). Thus, the coefficient (%) of utilizing an oxidation product of a color developing agent in the maximum density area for each of the light-sensitive units is a value represented by the following formula:

(dye forming amount in the maximum density area of light-sensitive unit)/(used amount of an oxidation product of a color developing agent in the maximum density area of light-sensitive unit)×100 wherein the dye forming amount in the maximum density area of light-sensitive unit can be determined from the value obtained in the foregoing (12). Thus, supposing that the measured value of Sample (b2) is a density obtained when all of the coupler contained in the light-sensitive unit concerned has performed dye formation, the dye forming amount corresponding the density of Sample (a2) can be determined. The used amount of an oxidation product of a color developing agent in the maximum density area of light-sensitive unit can be determined from the silver amount determined in (4). Thus, supposing that an equivalent number of a coupler and the silver amount are known, the using amount of an oxidation product of a color developing agent can be determined according to the following formula:

Used amount of an oxidation product of a color developing agent (mol)=(a)×(amount of developed silver, in mol) wherein "a" is an equivalent number of a coupler. The coating amount of silver of a coupler can also be determined by extraction from unexposed and unprocessed photographic material.

The ISO speed of a photographic material can be determined in accordance with the method described in JP-A No. 7-209827 or ISO 5800 "Photography-Color negative films for still photography-Determination of ISO speed".

The dry layer thickness, as defined in the invention refers to the thickness of from the lower end (lower surface) of the lowermost layer in contact with a support to the upper end (or upper surface) of the uppermost layer. This thickness can also determined by subtracting the support thickness from the total thickness of the photographic material. Alternatively, using a scanning type electron microscope, the thickness can be determined from a cross-sectional electron micrograph.

The silver halide tabular grain emulsion relating to the invention refers to a silver halide emulsion, in which silver halide grains contained are tabular silver halide grains (hereinafter, also denoted as tabular grains). The tabular grains are crystallographically classified as a twinned crystal. Thus, the twinned crystal is a silver halide crystal grain having one or more twin planes within the grain. Classification of the twinned crystals is detailed in Klein & Moisar, Photographische Korrepondenz, vol. 99, page 100, and ibid vol. 100 page 57.

The silver halide tabular grain emulsion according to the invention is one in which at least 50% of the total grain projected area is preferably accounted for by tabular grains having an aspect ratio of at least 2, more preferably 5 to 100, and still more preferably 8 to 100. The aspect ratio is a ratio of grain diameter to grain thickness (i.e., grain diameter/grain thickness). The aspect ratio can be determined in the following manner. A sample is prepared by coating a tabular grain emulsion containing a latex ball having a known diameter as an internal standard on a support so that the major faces are arranged parallel to the support surface. After being subjected to shadowing by carbon vapor evaporation, a replica sample is prepared in a conventional replica method. From electron micrographs of the sample, the diameter of a circle equivalent to the grain projected area and grain thickness are determined using an image processing apparatus. In this case, the grain thickness can be determined from the internal standard and silver halide grain shadow. The aspect ratio is adjustable within the foregoing range using commonly known methods.

The photographic material according to the invention can have a donor layer. The donor layer refers to a silver halide light-sensitive layer capable of providing an interimage effect to other layer(s), substantially having no image formed within the layer. The main purpose of providing this layer is to achieve more faithful color reproduction. Spectral sensitivity distributions of the donor layer and a layer subject to the interimage effect are an important factor. An exemplary example thereof is disclosed in JP-A No. 2000-105445. Thus, there exists a donor layer providing an interimage effect to the red-sensitive layer within the range of 500 to 600 nm, in which the gravity-center wavelength ($\lambda_{-R}$) of an interimage effect wavelength distribution in magnitude is 500 nm$\leqq\lambda_{-R}\leqq$560 nm; the donor layer exists closer to the support than the green-sensitive layer, thereby enhancing various greenish color reproductions (faithful reproduction) and maintaining human skin color reproducibility.

The photographic material according to the invention is exposed and developed, and images formed through development are read by scanner, in which the image data are digitized and the digital data can also be recorded on other recording medium. Techniques for reading images with a scanner, digitizing the image date and recording the digital data on other recording medium include, for example, those described in JP-A 11-52526, 11-52527, 11-52528, 11-52532, 11-65051, 11-109583, 11-133559, U.S. Pat. Nos. 5,519,510, 5,465,155; WO98/19216 and those described in JP-A 9-121265, 9-146247 and 9-294031.

As silver halide emulsions used in the invention can be employed those prepared with reference to JP-A 616643, 61-14630, 61-112142, 62-157024, 62-18556, 63-92942, 63-151618, 63-163451, 63-220238, 63-311244, RD38957 Sect. I and III, and RD40145 Sect. XV.

In cases where constituting color photographic materials using silver halide emulsions according to the invention, the silver halide emulsions which have subjected to physical ripening, chemical sensitization and spectral sensitization are employed. Additives used in such a process are described in RD38957 Sect. IV and V and RD40145 Sect. XV. Examples of commonly known photographic additives usable in the invention include those described in RD38957 Sect, II through X and RD40145 Sect. I through XIII.

DIR compounds are usable in the invention. Preferred examples thereof include compounds D-1 through D-34 describe din JP-A 4-114153. Further, examples of DIR compounds include those described in U.S. Pat. Nos. 4,234,678, 3,227,554, 3,647,291, 3,958,993, 4,419,886, 3,933,500; JP-A 57-56837, 51-13239; U.S. Pat. Nos. 2,072,363 and 2,070,266; and RD40145 Sect. XIV.

Additives used in the invention may be incorporation through dispersing methods described in RD 40145 Sect. VIII. Commonly known supports, as described in RD 38957 Sect. XV are usable in the invention. There may be provided light-insensitive layer (or auxiliary layer), such as a filter layer or interlayer in photographic materials relating to the invention.

Photographic materials relating to the invention can be processed using developers described in T. H. James, The Theory of the Photographic Process, Forth Edition, page 291 to 334 and Journal of American Chemical Society, 73 [3] 100 (1951), according to the conventional methods described RD 38957 Sect. XVII to XX, and RD 40145 Sect. XXIII.

EXAMPLES

The present invention will be further described based on examples but embodiments of the invention are not limited to these.

Example 1

On a subbed triacetyl cellulose film support, the following layers having composition as shown below were formed to prepare a multi-layered color photographic material Sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| | |
|---|---|
| 1st Layer: Anti-Halation Layer | |
| Black colloidal silver | 0.20 |
| UV- 1 | 0.30 |
| CM-1 | 0.040 |
| OIL-1 | 0.167 |
| Gelatin | 1.33 |
| 2nd Layer: Interlayer | |
| CM-1 | 0.10 |
| OIL-1 | 0.06 |
| Gelatin | 0.67 |
| 3rd Layer: Low-speed Red-Sensitive Layer | |
| Silver iodobromide emulsion a | 0.298 |
| Silver iodobromide emulsion b | 0.160 |
| SD-1 | $2.4 \times 10^{-5}$ |
| SD-2 | $9.6 \times 10^{-5}$ |
| SD-3 | $2.0 \times 10^{-4}$ |
| SD-4 | $8.9 \times 10^{-5}$ |
| SD-5 | $9.2 \times 10^{-5}$ |
| C-1 | 0.56 |
| CC-1 | 0.046 |
| OIL-2 | 0.35 |
| AS-2 | 0.001 |
| Gelatin | 1.35 |
| 4th Layer: Medium-speed Red-sensitive Layer | |
| Silver iodobromide emulsion c | 0.314 |
| Silver iodobromide emulsion d | 0.157 |
| SD-1 | $2.5 \times 10^{-5}$ |
| SD-2 | $5.6 \times 10^{-5}$ |
| SD-3 | $1.2 \times 10^{-4}$ |
| SD-4 | $2.0 \times 10^{-4}$ |
| SD-5 | $2.2 \times 10^{-4}$ |
| C-1 | 0.36 |
| CC-1 | 0.052 |
| Dl-1 | 0.022 |
| OIL-2 | 0.22 |
| AS-2 | 0.001 |
| Gelatin | 0.82 |
| 5th Layer: High-speed Red-Sensitive Layer | |
| Silver iodobromide emulsion c | 0.094 |
| Silver iodobromide emulsion e | 0.856 |
| SD-1 | $3.6 \times 10^{-5}$ |
| SD-4 | $2.5 \times 10^{-4}$ |
| SD-5 | $2.0 \times 10^{-4}$ |
| C-2 | 0.17 |
| C-3 | 0.088 |
| CC-1 | 0.041 |
| DI-4 | 0.012 |
| OIL-2 | 0.16 |
| AS-2 | 0.002 |
| Gelatin | 1.30 |
| 6th Layer: Interlayer | |
| OIL-1 | 0.20 |
| AS-1 | 0.16 |
| Gelatin | 0.89 |
| 7th Layer: Low-speed Green-Sensitive Layer | |
| Silver iodobromide emulsion a | 0.19 |
| Silver iodobromide emulsion d | 0.19 |
| SD-6 | $1.2 \times 10^{-4}$ |
| SD-7 | $1.1 \times 10^{-4}$ |
| M-1 | 0.26 |
| CM-1 | 0.070 |
| OIL-1 | 0.35 |
| DI-2 | 0.007 |
| Gelatin | 1.10 |
| 8th Layer: Medium-speed Green-Sensitive Layer | |
| Silver iodobromide emulsion C | 0.41 |
| Silver iodobromide emulsion d | 0.19 |
| SD-6 | $7.5 \times 10^{-5}$ |

-continued

| | |
|---|---|
| SD-7 | $4.1 \times 10^{-4}$ |
| SD-8 | $3.0 \times 10^{-4}$ |
| SD-9 | $6.0 \times 10^{-5}$ |
| SD-10 | $3.9 \times 10^{-5}$ |
| M-1 | 0.05 |
| M-4 | 0.11 |
| CM-1 | 0.024 |
| CM-2 | 0.028 |
| DI-3 | 0.001 |
| Dl-2 | 0.010 |
| OIL-1 | 0.22 |
| AS-2 | 0.001 |
| Gelatin | 0.80 |
| 9th Layer: High-speed Green-Sensitive Layer | |
| Silver iodobromide emulsion a | 0.028 |
| Silver iodobromide emulsion e | 0.49 |
| SD-6 | $5.5 \times 10^{-6}$ |
| SD-7 | $5.2 \times 10^{-5}$ |
| SD-8 | $4.3 \times 10^{-4}$ |
| SD-10 | $2.6 \times 10^{-5}$ |
| SD-11 | $1.3 \times 10^{-4}$ |
| M-1 | 0.068 |
| CM-2 | 0.015 |
| Dl-3 | 0.029 |
| OIL-1 | 0.14 |
| OIL-3 | 0.13 |
| AS-2 | 0.001 |
| Gelatin | 1.00 |
| 10th Layer: Yellow Filter Layer | |
| Yellow colloidal silver | 0.06 |
| OIL-1 | 0.18 |
| AS-1 | 0.14 |
| Gelatin | 0.90 |
| 11th Layer: Low-speed Blue-sensitive Layer | |
| Silver iodobromide emulsion d | 0.11 |
| Silver iodobromide emulsion a | 0.15 |
| Silver iodobromide emulsion f | 0.11 |
| SD-12 | $1.0 \times 10^{-4}$ |
| SD-13 | $2.0 \times 10^{-4}$ |
| SD-14 | $1.6 \times 10^{-4}$ |
| SD-15 | $1.3 \times 10^{-4}$ |
| Y-1 | 0.71 |
| DI-3 | 0.016 |
| AS-2 | 0.001 |
| OIL-1 | 0.22 |
| Gelatin | 1.38 |
| 12th Layer: High-sped Blue-sensitive Layer | |
| Silver iodobromide emulsion f | 0.31 |
| Silver iodobromide emulsion g | 0.56 |
| SD-12 | $7.5 \times 10^{-5}$ |
| SD-15 | $4.0 \times 10^{-4}$ |
| Y-1 | 0.26 |
| DI-4 | 0.054 |
| As-2 | 0.001 |
| OIL-1 | 0.13 |
| Gelatin | 1.06 |
| 13th Layer: First Protective Layer | |
| Silver iodobromide emulsion h | 0.20 |
| UV-1 | 0.11 |
| UV-2 | 0.055 |
| OIL-3 | 0.20 |
| Gelatin | 1.00 |
| 14th Layer: Second protective Layer | |
| PM-1 | 0.10 |
| PM-2 | 0.018 |
| WAX-1 | 0.020 |
| SU-1 | 0.002 |
| SU-2 | 0.002 |
| Gelatin | 0.55 |

Characteristics of silver iodobromide emulsions a through j described above are shown below, in which the average grain size refers to an edge length of a cube having the same volume as that of the grain.

TABLE 1

| Emulsion | Av. grain size (μm) | Av. iodide content (mol %) | Diameter/thickness ratio | Coefficient of variation (%) |
|---|---|---|---|---|
| a | 0.27 | 2.0 | 1.0 | 15 |
| b | 0.42 | 4.0 | 1.0 | 17 |
| c | 0.56 | 3.8 | 4.5 | 25 |
| d | 0.38 | 8.0 | 1.0 | 15 |
| e | 0.87 | 3.8 | 5.0 | 21 |
| f | 0.60 | 7.7 | 3.0 | 18 |
| g | 1.00 | 7.6 | 4.0 | 15 |
| h | 0.05 | 2.0 | 1.0 | 30 |

With regard to the foregoing emulsions, except for emulsion h, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 100,000; inhibitors AF-3, AF-4 and AF-5; hardener H-1 and H-2; and antiseptic Ase-1.

The structure of the compounds used in the sample are shown below.

Y-1

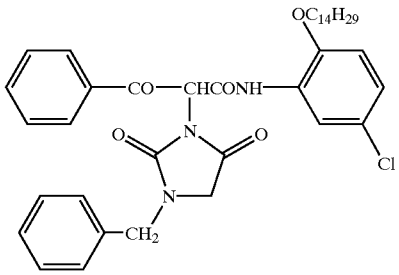

M-1

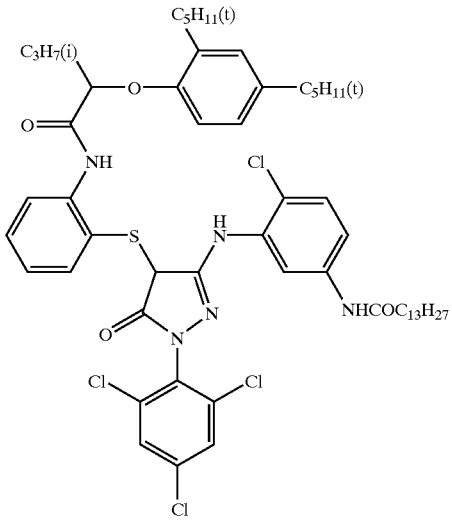

M-2

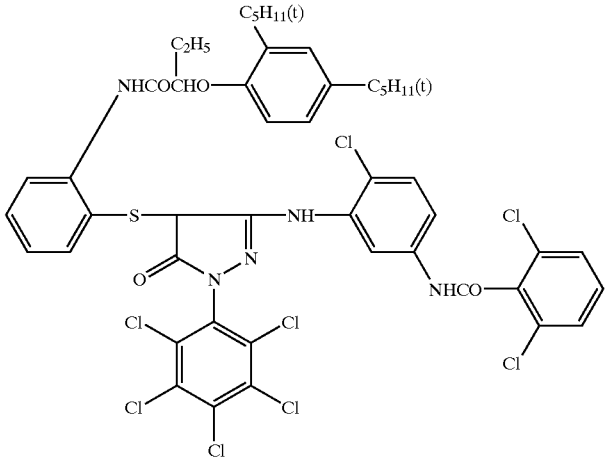

-continued
M-3
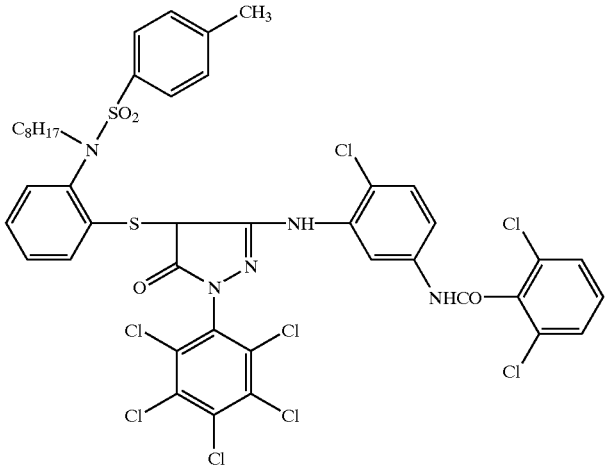
M-4
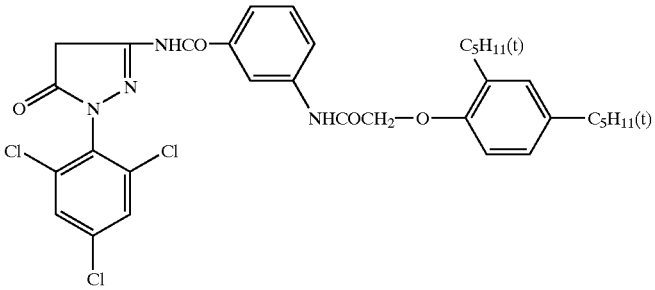
C-1
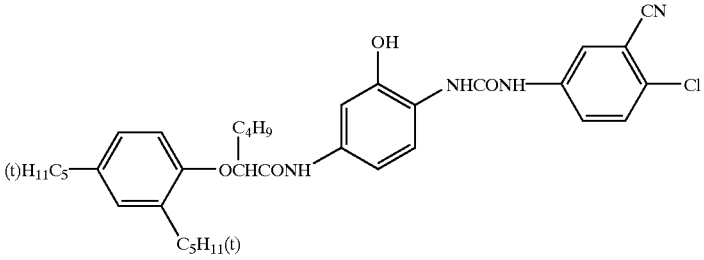
C-2
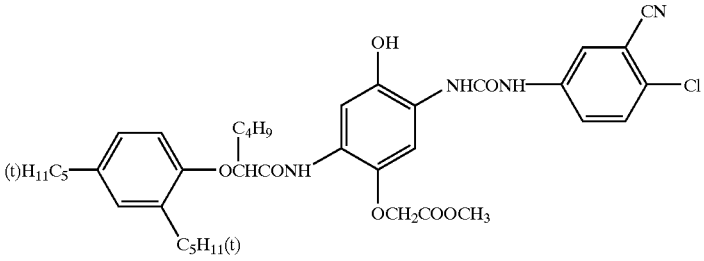

-continued
C-3
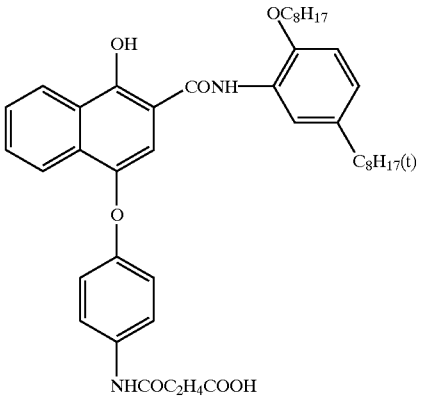
CC-1
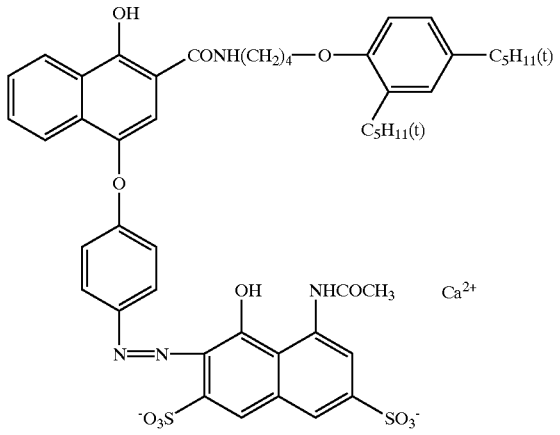
CM-1
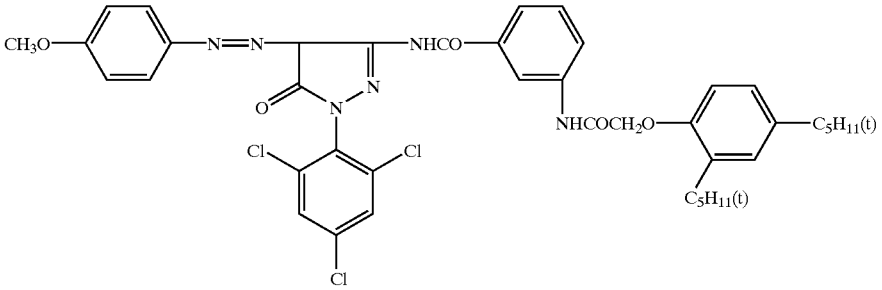
CM-2
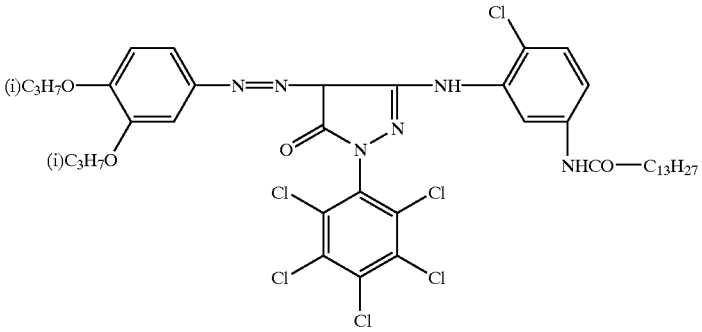

-continued
DI-1
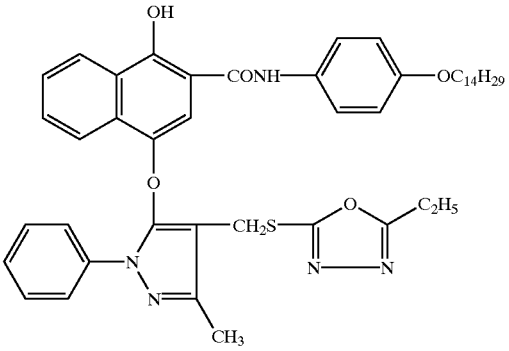
DI-2
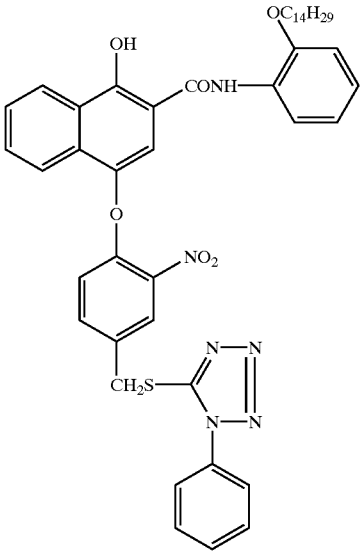
DI-3
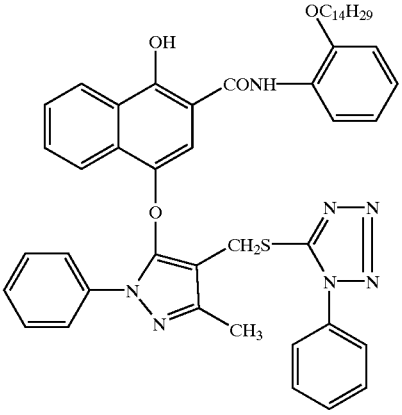
DI-4
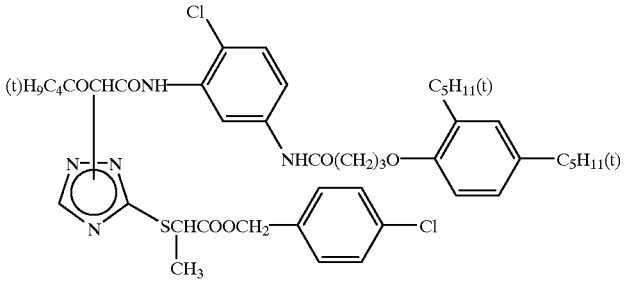
AS-1
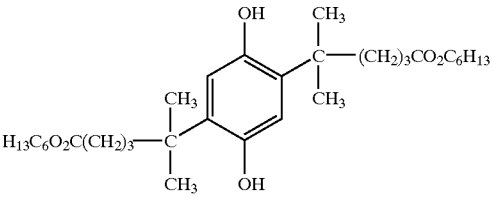
AS-2
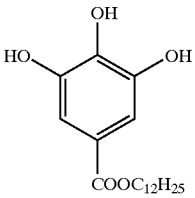
AS-3
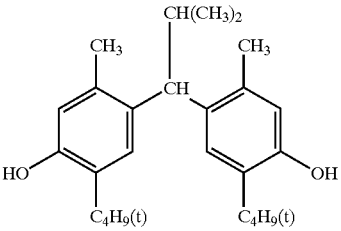
AS-4
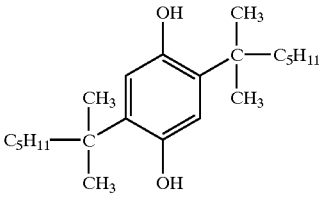

-continued
OIL-1
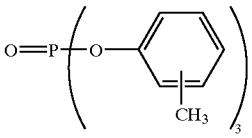
OIL-2
$H_9C_4OOC(CH_2)_8COOC_4H_9$
UV-1
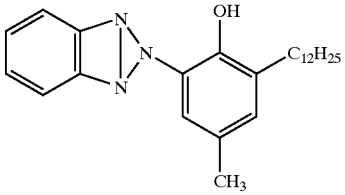
OIL-3
Liquid paraffin
UV-2
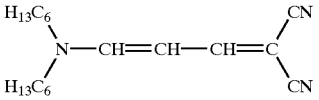
V-1
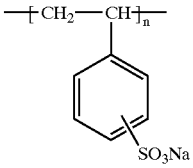
n: Degree of polymerization
Ase-1 (Mixture)
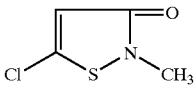
A
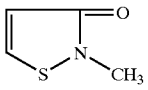
B
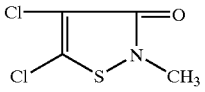
C
A:B:C = 50:46:4
H-1
$CH_2{=}CHSO_2{-}CH_2CONHC_2H_4NHCOCH_2{-}SO_2CH{=}CH_2$
H-2
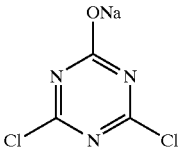
SD-1
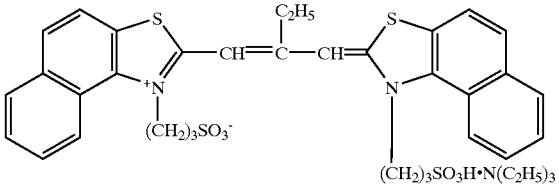
SD-2
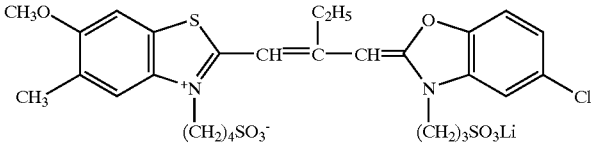
SD-3
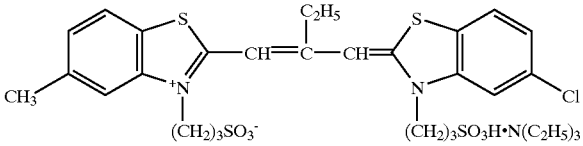
SD-4
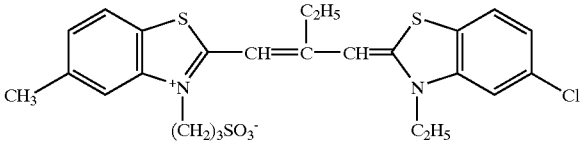

-continued
SD-5
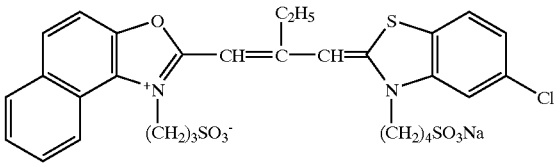
SD-6
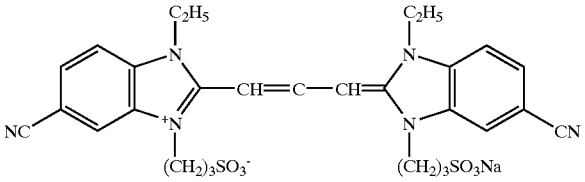
SD-7
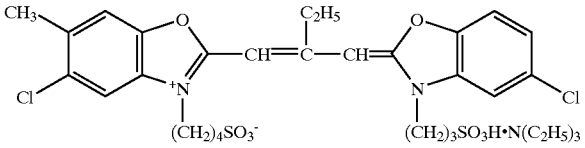
SD-8
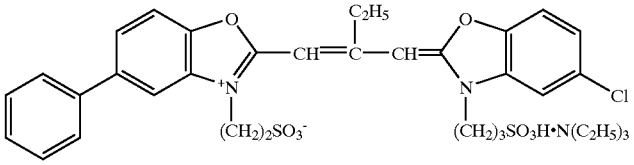
SD-9
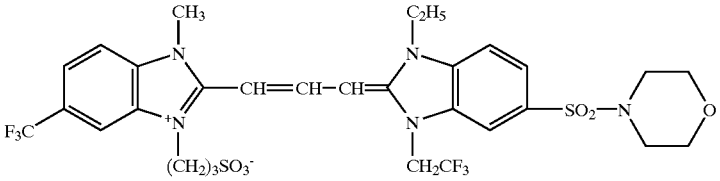
SD-10
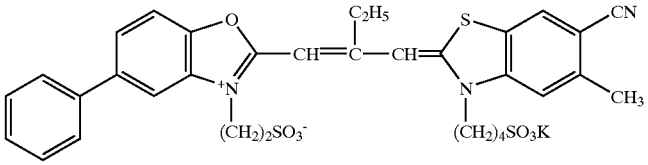
SD-11
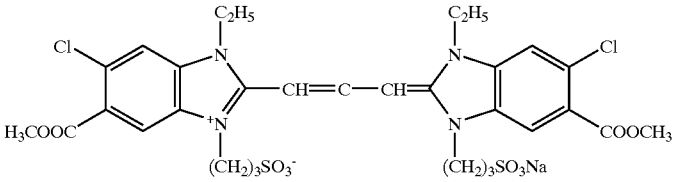
SD-12
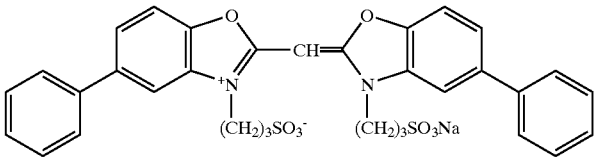
SD-13
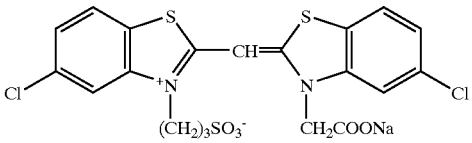

-continued
SD-14
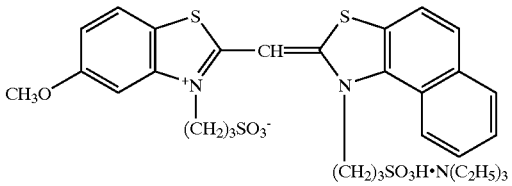
SD-15
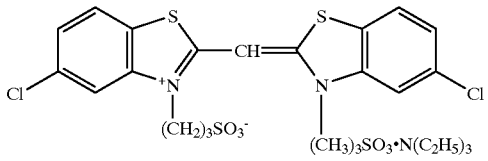
ST-1
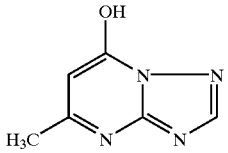
ST-2
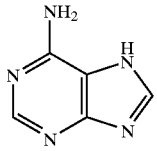
AF-1,2
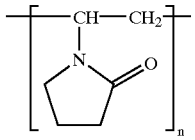
AF-2 Mw ≒ 10,000
AF-2 Mw ≒ 100,000
n: Degree of polymerization
AF-3
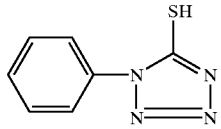
AF-4
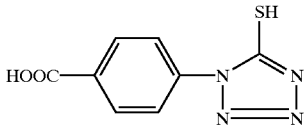
AF-5
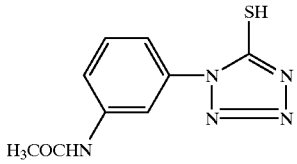
X-1
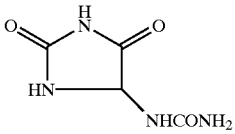
SU-1
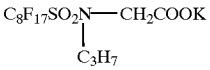
SU-2
$C_8F_{17}SO_2NH(CH_2)_3N^+(CH_3)_3Br^-$
SU-3
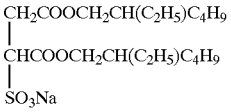
SU-4
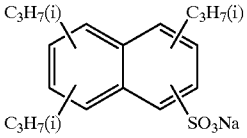
WAX-1
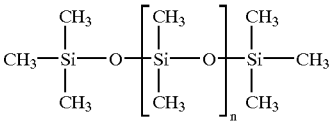
Mw = 3,000
PM-1
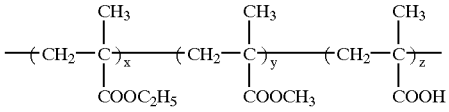
x:y:z = 3:3:4
PM-2
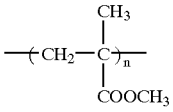
n: Degree of polymerization Samples 102 was prepared similarly to Sample 101, except that M-1 used in the 7th, 8th and 9th layers was replaced by an equimolar amount of M-a. Sample 103 was prepared similarly to Sample 101, except that C-2 and C-3 used in the 5th layer was replaced by an equimolar amount of C-1.

Sample 104 was prepared as follows.

| | |
|---|---|
| 1st Layer: Anti-Halation Layer | |
| Black colloidal silver | 0.16 |
| UV-1 | 0.30 |
| CM-1 | 0.12 |
| OIL-1 | 0.24 |
| Gelatin | 1.33 |
| 2nd Layer: Interlayer | |
| Silver iodobromide emulsion i | 0.06 |
| AS-1 | 0.12 |
| OIL-1 | 0.15 |
| Gelatin | 0.67 |
| 3rd Layer: Low-speed Red-Sensitive Layer | |
| Silver iodobromide emulsion h | 0.39 |
| Silver iodobromide emulsion e | 0.32 |
| SD-1 | $2.2 \times 10^{-5}$ |
| SD-2 | $6.7 \times 10^{-5}$ |
| SD-3 | $1.5 \times 10^{-4}$ |
| SD-4 | $1.4 \times 10^{-4}$ |
| SD-5 | $1.4 \times 10^{-4}$ |
| C-1 | 0.77 |
| CC-1 | 0.006 |
| OIL-2 | 0.47 |
| AS-2 | 0.002 |
| Gelatin | 1.79 |
| 4th Layer: Medium-speed Red-sensitive Layer | |
| Silver iodobromide emulsion b | 0.86 |
| Silver iodobromide emulsion h | 0.37 |
| SD-1 | $1.8 \times 10^{-5}$ |
| SD-4 | $2.5 \times 10^{-4}$ |
| SD-5 | $2.6 \times 10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| 5th Layer: High-speed Red-Sensitive Layer | |
| Silver iodobromide emulsion a | 1.45 |
| Silver iodobromide emulsion e | 0.076 |
| SD-1 | $3.0 \times 10^{-5}$ |
| SD-4 | $2.1 \times 10^{-4}$ |
| SD-5 | $1.4 \times 10^{-4}$ |
| C-2 | 0.10 |
| C-3 | 0.17 |
| CC-1 | 0.013 |
| DI-5 | 0.044 |
| OIL-2 | 0.17 |
| AS-2 | 0.004 |
| Gelatin | 1.40 |
| 6th Layer: Interlayer | |
| Y-1 | 0.095 |
| AS-1 | 0.11 |
| OIL-1 | 0.17 |
| Gelatin | 1.00 |
| 7th Layer: Low-speed Green-Sensitive Layer | |
| Silver iodobromide emulsion h | 0.32 |
| Silver iodobromide emulsion e | 0.11 |
| SD-6 | $3.5 \times 10^{-5}$ |
| SD-7 | $3.1 \times 10^{-4}$ |
| SD-8 | $2.1 \times 10^{-4}$ |
| SD-9 | $1.3 \times 10^{-4}$ |
| SD-10 | $2.7 \times 10^{-5}$ |
| M-1 | 0.19 |

-continued

| | |
|---|---|
| M-3 | 0.20 |
| CM-1 | 0.042 |
| DI-2 | 0.010 |
| OIL-1 | 0.41 |
| AS-2 | 0.002 |
| AS-3 | 0.067 |
| Gelatin | 1.24 |
| 8th Layer: Medium-speed Green-Sensitive Layer | |
| Silver iodobromide emulsion b | 0.54 |
| Silver iodobromide emulsion e | 0.23 |
| SD-8 | $3.0 \times 10^{-4}$ |
| SD-9 | $1.7 \times 10^{-4}$ |
| SD-10 | $2.4 \times 10^{-5}$ |
| M-1 | 0.058 |
| M-3 | 0.094 |
| CM-1 | 0.042 |
| CM-2 | 0.044 |
| DI-2 | 0.025 |
| OIL-1 | 0.27 |
| AS-3 | 0.046 |
| AS-4 | 0.006 |
| Gelatin | 1.22 |
| 9th Layer: High-speed Green-Sensitive Layer | |
| Silver iodobromide emulsion a | 1.11 |
| Silver iodobromide emulsion b | 0.13 |
| Silver iodobromide emulsion e | 0.066 |
| SD-6 | $2.8 \times 10^{-6}$ |
| SD-7 | $2.6 \times 10^{-5}$ |
| SD-8 | $3.2 \times 10^{-4}$ |
| SD-9 | $1.7 \times 10^{-5}$ |
| SD-10 | $2.0 \times 10^{-5}$ |
| SD-11 | $1.2 \times 10^{-4}$ |
| M-1 | 0.046 |
| M-2 | 0.070 |
| CM-2 | 0.010 |
| DI-3 | 0.003 |
| OIL-1 | 0.22 |
| AS-2 | 0.008 |
| AS-3 | 0.035 |
| Gelatin | 1.38 |
| 10th Layer: Yellow Filter Layer | |
| Yellow colloidal silver | 0.053 |
| AS-1 | 0.15 |
| OIL-1 | 0.18 |
| Gelatin | 0.83 |
| 11th Layer: Low-speed Blue-sensitive Layer | |
| Silver iodobromide emulsion g | 0.29 |
| Silver iodobromide emulsion d | 0.098 |
| Silver iodobromide emulsion c | 0.098 |
| SD-12 | $1.6 \times 10^{-4}$ |
| SD-13 | $2.2 \times 10^{-4}$ |
| SD-14 | $1.1 \times 10^{-4}$ |
| SD-15 | $3.2 \times 10^{-4}$ |
| Y-1 | 0.95 |
| OIL-1 | 0.29 |
| AS-2 | 0.0014 |
| X-1 | 0.10 |
| Gelatin | 1.79 |
| 12th Layer: High-sped Blue-sensitive Layer | |
| Silver iodobromide emulsion f | 1.14 |
| Silver iodobromide emulsion g | 0.32 |
| SD-12 | $7.4 \times 10^{-5}$ |
| SD-15 | $3.0 \times 10^{-4}$ |
| Y-1 | 0.31 |
| DI-5 | 0.11 |
| OIL-1 | 0.17 |
| AS-2 | 0.010 |
| X-1 | 0.098 |
| Gelatin | 1.15 |
| 13th Layer: First Protective Layer | |
| Silver iodobromide emulsion i | 0.20 |
| UV-1 | 0.11 |
| UV-2 | 0.055 |

-continued

| | |
|---|---|
| X-1 | 0.078 |
| Gelatin | 0.70 |
| 14th Layer: Second protective Layer | |
| PM-1 | 0.13 |
| PM-2 | 0.018 |
| WAX-1 | 0.021 |
| Gelatin | 0.55 |

Characteristics of silver iodobromide emulsions described above are shown below, in which the average grain size refers to an edge length of a cube having the same volume as that of the grain.

TABLE 2

| Emulsion | Av. Grain Size (μm) | Av. Iodide Content (mol %) | Diameter/thickness Ratio |
|---|---|---|---|
| a | 1.0 | 3.2 | 7.0 |
| b | 0.70 | 3.3 | 6.5 |
| c | 0.30 | 1.9 | 5.5 |
| d | 0.38 | 8.0 | Octahedral, twinned |
| e | 0.27 | 2.0 | Tetradehedral, twinned |
| f | 1.20 | 8.0 | 2.5 |
| g | 0.60 | 8.0 | 3.2 |
| h | 0.42 | 4.0 | Cubic |
| i | 0.03 | 2.0 | 1.0 |

With regard to the foregoing emulsions, except for emulsion i, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100, 000; inhibitors AF-3, AF-4 and AF-5; hardener H-1 and H-2; and antiseptic Ase-1.

The coefficient of utilization of an oxidation product of a color developing agent was determined for each of Sample 101 trough 104 when exposed to neutral white light. Further, graininess and radiation resistance were also evaluated for each sample.

Graininess Evaluation

Samples were each exposed to light through an optical stepped wedge for a period of 1/100 sec., using a light source of 54000° K and then processed in accordance with the process described in JP-A 10-123652, col. [0220] through [0227]. Subsequently, processed samples were measured with respect to magenta density, using a densitometer produced by X-rite Co. A characteristic curve of density (D) and exposure (Log E) was prepared to evaluate graininess. Thus, at a density of minimum density plus 0.10 on the characteristic curve was measured, through a green filter, RMS granularity (i.e., 1000 times value of variation in density occurred when a density of minimum density plus 0.30 was scanned with micro-densitometer, product by Konica Corp. at a aperture scanning area of 250 $\mu m^2$). RMS granularity was represented by a relative value, based the RMS granularity of Sample 101 being 100. The less granularity indicates better graininess.

Radiation Resistance Evaluation

Samples were each exposed to radiation of 200 mR dose using 137 Cs as a radiation source. Thereafter, similarly to the foregoing, exposure and processing were carried out for each sample. Results were represented by a relative value, based on the RMS value of Sample 101 being 100. The less granularity value indicates a better result.

Results are shown in Table 3.

TABLE 3

| | Coefficient of Utilization | | | Green Sensitive Layer | | |
|---|---|---|---|---|---|---|
| | Blue-sensitive Layer | Green-sensitive Layer | Red-sensitive Layer | Granularity | Radiation Resistance | Remark |
| 101 | 85% | 50% | 90% | 100 | 115 | Inv. |
| 102 | 85% | 25% | 90% | 140 | 180 | Comp. |
| 103 | 85% | 50% | 80% | 95 | 110 | Inv. |
| 104 | 80% | 50% | 85% | 90 | 110 | Inv. |

As is apparent from the results, inventive samples exhibited superior graininess (i.e., lower granularity) and improved radiation resistance.

Example 2

Sample 201 was prepared in accordance with Sample 103 of JP-A 2000-89420.

Sample 202 was prepared similarly to Sample 201, except that silver iodobromide emulsion c of the 5th layer, silver iodobromide emulsion e of the 9th layer and silver iodobromide emulsion h of the 12th layer were replaced by silver iodobromide emulsions having an aspect ratio of 8.0, 9.0 and 5.0, respectively. Sample 2–3 was prepared similarly sample 201, except that the iodide content of silver iodobromide emulsions newly introduced in Sample 2 was changed to 2.0 mol %.

The silver halide-coefficient of development was determined for each of Sample 201 trough 203 when subjected to neutral white light exposure (N) or separation exposure (D). Further, similarly to Example 1, graininess and radiation resistance were also evaluated for each sample.

Results are shown in Table 4.

TABLE 4

| | Development Coefficient (N) | | Development Coefficient (D) | | Green-sensitive Layer | | |
|---|---|---|---|---|---|---|---|
| | Blue-sensitive Layer | Red-sensitive Layer | Blue-sensitive Layer | red-sensitive Layer | Granularity | Radiation Resistance | Remark |
| 201 | 45% | 35% | 65% | 65% | 100 | 110 | Comp. |
| 202 | 60% | 50% | 80% | 80% | 90 | 105 | Inv. |
| 203 | 65% | 55% | 85% | 85% | 95 | 105 | Inv. |

As is apparent, inventive samples exhibited superior graininess and improved radiation resistance.

Example 3

Samples 301 and 302 were prepared in the same manner as Sample 101 of example 1 and Sample 201 of Example 2. The thus prepared samples were each evaluated. Thus, the coefficient of utilization of an oxidation product of a color developing agent, coupler dye-forming coefficient and ISO speed were determined for each of Sample 301 and 302 when subjected to neutral white light exposure. Further, similarly to Example 1 and Example 2, dry layer thickness, graininess and radiation resistance were also evaluated for each sample.

Results are shown in Table 5.

TABLE 5

| | Use Factor | | | Dye forming Factor | | | | Dry Layer | Green-sensitive Layer | | |
|---|---|---|---|---|---|---|---|---|---|---|---|
| | Blue-sensitive Layer | Green-sensitive Layer | Red-sensitive Layer | Blue-sensitive Layer | Green-sensitive Layer | Red-sensitive Layer | ISO Speed | Thickness (μm) | Granularity tance | Radiation Resis | Remark |
| 301 | 85% | 50% | 90% | 80% | 80% | 65% | 400 | 18 | 100 | 115 | Inv. |
| 302 | 75% | 25% | 80% | 70% | 65% | 70% | 200 | 17 | 105 | 115 | Comp. |

As is apparent form the Table, the inventive sample exhibited superior graininess and improved radiation resistance.

What is claimed is:

1. A silver halide photographic light-sensitive material comprising on a support a blue-sensitive silver halide light-sensitive unit comprising at least a blue-sensitive silver halide emulsion layer containing a yellow coupler, a green-sensitive silver halide light-sensitive unit comprising at least a green-sensitive silver halide emulsion layer containing a magenta coupler, and a red-sensitive silver halide light-sensitive unit comprising at least a red-sensitive silver halide emulsion layer containing a cyan coupler, wherein a coefficient of utilization of an oxidation product of a color developing agent in a maximum density area of the blue-sensitive unit (CUB) is not less than 80%, that of the green-sensitive unit (CUG) is 30 to 75% and that of the red-sensitive unit (CUR) is not less than 80%.

2. The silver halide photographic material of claim 1, wherein the coefficient of utilization of an oxidation product of a color developing agent in a maximum density area of each of the light-sensitive units meets the following requirement:

CUB>CUR>CUG.

3. The silver halide photographic material of claim 1, wherein the coefficient of utilization of an oxidation product of a color developing agent in a maximum density area of each of the light-sensitive units meets the following requirement:

CUR>CUB>CUG.

4. The silver halide photographic material of claim 1, wherein the photographic material has an ISO speed of not less than 320.

5. The silver halide photographic material of claim 1, wherein the photographic material has a dry layer thickness of not more than 20 μm.

6. The silver halide photographic material of claim 1, wherein the photographic material has a silver coverage of not more than 50 mg/m$^2$.

7. The silver halide photographic material of claim 1, wherein a coefficient of development of silver halide in a maximum density area of the blue-sensitive unit is 70 to 90% when exposed to blue light and being 50 to 70% when exposed to neutral white light.

8. The silver halide photographic material of claim 1, wherein a coefficient of development of silver halide in a maximum density area of the red-sensitive unit is 70 to 90% when exposed to red light and is 40 to 60% when exposed to neutral white light.

9. The silver halide photographic material of claim 1, wherein at least one of the light-sensitive units exhibits a coupler dye-forming coefficient in a maximum density area of not less than 80%, and the photographic material having an ISO speed of not less than 320.

10. The silver halide photographic material of claim 1, wherein at least one of the light-sensitive units exhibits a coupler dye-forming coefficient in a maximum density area of not less than 80%, and the photographic material having a dry layer thickness of not more than 20 μm.

* * * * *